United States Patent [19]

Staton

[11] 4,198,576

[45] Apr. 15, 1980

[54] HOLIDAY CONTROL UNIT

[75] Inventor: Thomas R. Staton, Concord, Calif.

[73] Assignee: American Building Maintenance Industries, San Francisco, Calif.

[21] Appl. No.: 973,180

[22] Filed: Dec. 26, 1978

[51] Int. Cl.[2] ..... H01H 43/20

[52] U.S. Cl. ..... 307/141.8

[58] Field of Search ..... 200/38 DB, 38 DA, 38 FB; 307/141, 141.8; 340/309.6

[56] References Cited

U.S. PATENT DOCUMENTS 2,848,630 8/1958 McNicol et al. ..... 200/38 DB X

*Primary Examiner*—L. T. Hix
*Assistant Examiner*—James L. Dwyer
*Attorney, Agent, or Firm*—Julian Caplan

[57] ABSTRACT

This unit interrupts normal operation of an electrical circuit energized in cycles by a time clock, for one of the cycles. The unit includes a first means actuable by means of a switch for bypassing the control circuit, at any time when it is desired to interrupt normal operation of the circuit during the next cycle. A second means for bypassing the first means does so if the circuit is energized at the time the switch is closed. A third means bypasses the control circuit when the second means is not actuated and the circuit is not in operation. The second bypassing means turns off if it is on when the time clock next turns off. The third bypassing means turns on when the time clock turns on again, and it returns the circuit to normal operation when the time clock turns off once again.

5 Claims, 2 Drawing Figures

HOLIDAY CONTROL UNIT

BACKGROUND OF THE INVENTION

1. Field of the Invention

This invention relates to a unit for interrupting normal operation of an electrical circuit in which a control relay is actuated by a time clock. More particularly, it relates to such a unit which will interrupt the normal operation of the circuit in the next cycle of a plurality of cycles defined by the time clock when the unit is actuated during a particular cycle. Most especially, it relates to such a unit which can be installed between the time clock and control relay of an existing circuit without substantial modification to either.

2. Description of the Prior Art

Most business and commercial buildings have various electrical circuits, such as those used for operating heating and cooling systems for the buildings, which are automatically controlled by time clocks to provide required heating or cooling during normal business hours each day. It has long been recognized that it is desirable to override such normal operation of these systems during weekends, holidays and other special occasions when the usual daily business is not carried out. For example, a manual override switch provided as part of a time clock for this purpose is disclosed in Smith, U.S. Pat. No. 1,981,282 and Klein, U.S. Pat. No. 2,890,300.

It is also known to provide time clocks for such circuits that will automatically skip normal operation without requiring manual setting each time this is to be done. Such time clocks typically incorporate pins or similar members for interfering with normal operation of cams on pre-selected days of a week. Such an arrangement is disclosed in, for example, Klein et al, U.S. Pat. No. 2,921,149 and Prewarski et al, U.S. Pat. No. 3,929,284. While the approach of the latter two patents has achieved acceptance for new installations, particularly in buildings large enough to have full time maintenance employees, it is neither suitable for installation on existing time clock circuits without replacing the entire time clock mechanism, nor is it suited for use in small or medium sized commercial buildings which do not have full time maintenance employees for setting such mechanisms. Problems are encountered when individuals unfamiliar with the time clock mechanism attempt to set the day-skipping controls, both from improper setting and exposure to electrical shock hazards. A need therefore exists for improvement in day-skipping mechanisms for use with time clock controlled electrical circuits to overcome these problems.

SUMMARY OF THE INVENTION

Accordingly, it is an object of this invention to provide a unit for interrupting normal daily operation of an electrical circuit controlled by a time clock that can be installed to interact with existing time clocks without substantial modification of them.

It is another object of this invention to provide a unit for selectively interrupting normal daily operation of an electrical circuit controlled by a time clock which does not require a user to have access to the time clock for setting.

It is still another object of the invention to provide such a unit which will allow selective interruption of the normal operation of the circuit for a desired time period, regardless of the state of the circuit at the time the unit is set and at the time interruption of normal circuit operation is to be terminated.

It is still another object of the invention to provide such a unit which can be reset to return the circuit to normal operation independent of the state of the circuit or the unit at the time resetting is desired.

The attainment of these and related objects may be achieved through the use of the holiday control unit herein disclosed. This unit interrupts normal operation of an electrical circuit which is usually energized during a cycle by a time clock, for one such cycle, then returns the circuit to normal operation. The unit includes a first means actuable by means of a switch at any time for bypassing the control circuit to interrupt normal operation of the circuit during the next cycle. A second bypassing means allows the control circuit to continue its function in the normal manner during a particular cycle if the circuit is in operation when the actuating switch is closed. A third means for bypassing the control circuit does so only if the second means is not actuated. The second bypassing means turns off when the time clock turns off. The third bypassing means then turns on when the time clock turns on again, thus interrupting normal operation in that cycle. Both the first and third bypassing means return the circuit to normal operation when the time clock operates to turn off the control circuit during the interrupted cycle. Normal operation of the circuit then resumes in the following cycle.

Such a combination of bypassing means allows the unit to be set during a first cycle to interrupt normal circuit operation during a second cycle and return to normal operation during a third cycle, independently of the state of the circuit at the time the unit is set during the first cycle to interrupt operation during the second cycle. Such a unit may be cascaded with another such unit when it is desired to interrupt normal operation of the circuit for more than one cycle at a time.

The attainment of the foregoing and related objects, advantages and features of the invention should be more readily apparent after review of the following detailed description of the invention, taken together with the drawings, in which:

DETAILED DESCRIPTION OF THE INVENTION

Figure 1:
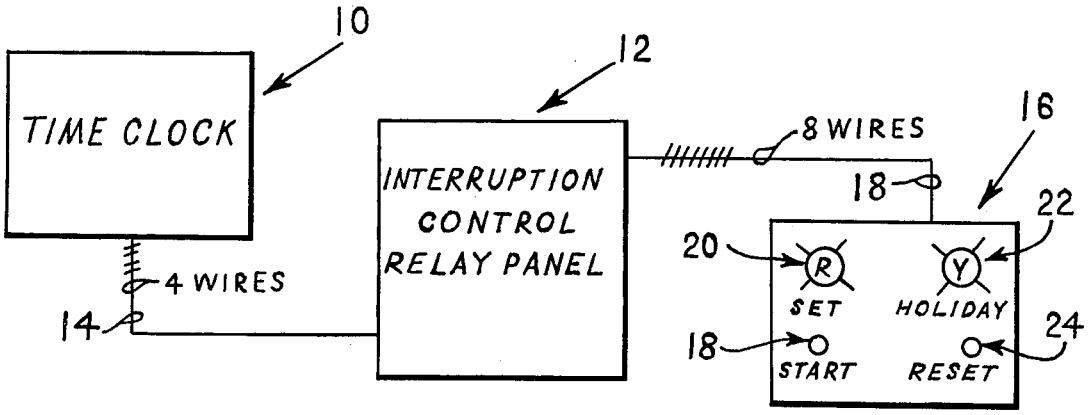
FIG. 1 is a block diagram showing a typical installation incorporating the invention.

Turning now to the drawings, more particularly to FIG. 1, a system incorporating a holiday control unit in accordance with the invention is shown. The system includes a conventional time clock 10 which is similar to those disclosed in the above-referenced patents, but may or may not include a day-skipping feature as disclosed in those patents. Typically, the unit of this invention would be employed with a time clock that does not already include a day-skipping feature. However, the unit is useful with a time clock which includes a programmable means for skipping days in a regular cycle, such as weekends. When incorporated with such a time clock, the unit of this invention may be utilized for skipping days of normal operation on an irregular basis, such as for holidays. The unit includes an interruption control relay panel 12 containing a plurality of relays used to implement the interruption function, which will be described in more detail in the discussion of FIG. 2. Cable 14 connects the interruption control relay panel 12 to the time clock 10. As shown, cable 14 contains four individual wires, all that are required to connect the interruption control relay panel 12 to a typical time clock for controlling electrical operation. The interruption control relay panel 12 is connected to a remote control panel 16 by means of cable 18. Cable 18 is a light duty cable containing eight individual wires in order to make the necessary connections required between remote control panel 16 and interruption control relay panel 12.

In a typical installation, the interruption control relay panel 12 would be installed near the time clock 10 in a utility area of a building, along with the central heating and air conditioning units for the building. The remote control panel 16 would typically be installed near a thermostat in an office area or other convenient place of access for the user.

Remote control panel 16 includes a start switch 18 which is depressed by the user on the day previous to a day for which normal operation of the circuit controlled by time clock 10 is to be interrupted. An indicator light 20 is provided on the panel 16, which is illuminated when start button 18 is depressed to set the holiday control unit. Light 20 remains illuminated after the unit has been set by depressing switch 18 to show that the unit is ready to interrupt normal operation of the circuit controlled by time clock 10 the next day. The next day, when time clock 10 turns on to energize the electrical circuit, the interruption unit diverts the current to prevent operation of the circuit and light 22 is illuminated to show that the interruption function is taking place. At the end of the day for which normal circuit operation is interrupted by the unit, when time clock 10 acts in its usual manner to terminate circuit operation in accordance with its usual cycle, the result is to disconnect the interruption unit and return the time clock to normal operation of its associated control relay. At this time, light 22 is extinguished to show that the holiday control unit is no longer in operation. Subsequently, when the time clock provides an appropriate signal to actuate the control relay connected to it, the circuit operates in its normal manner. Remote control panel 16 also includes a reset switch 24 for cancelling actuation of the interruption unit in the event of a mistake or a change in plans.

Figure 2:
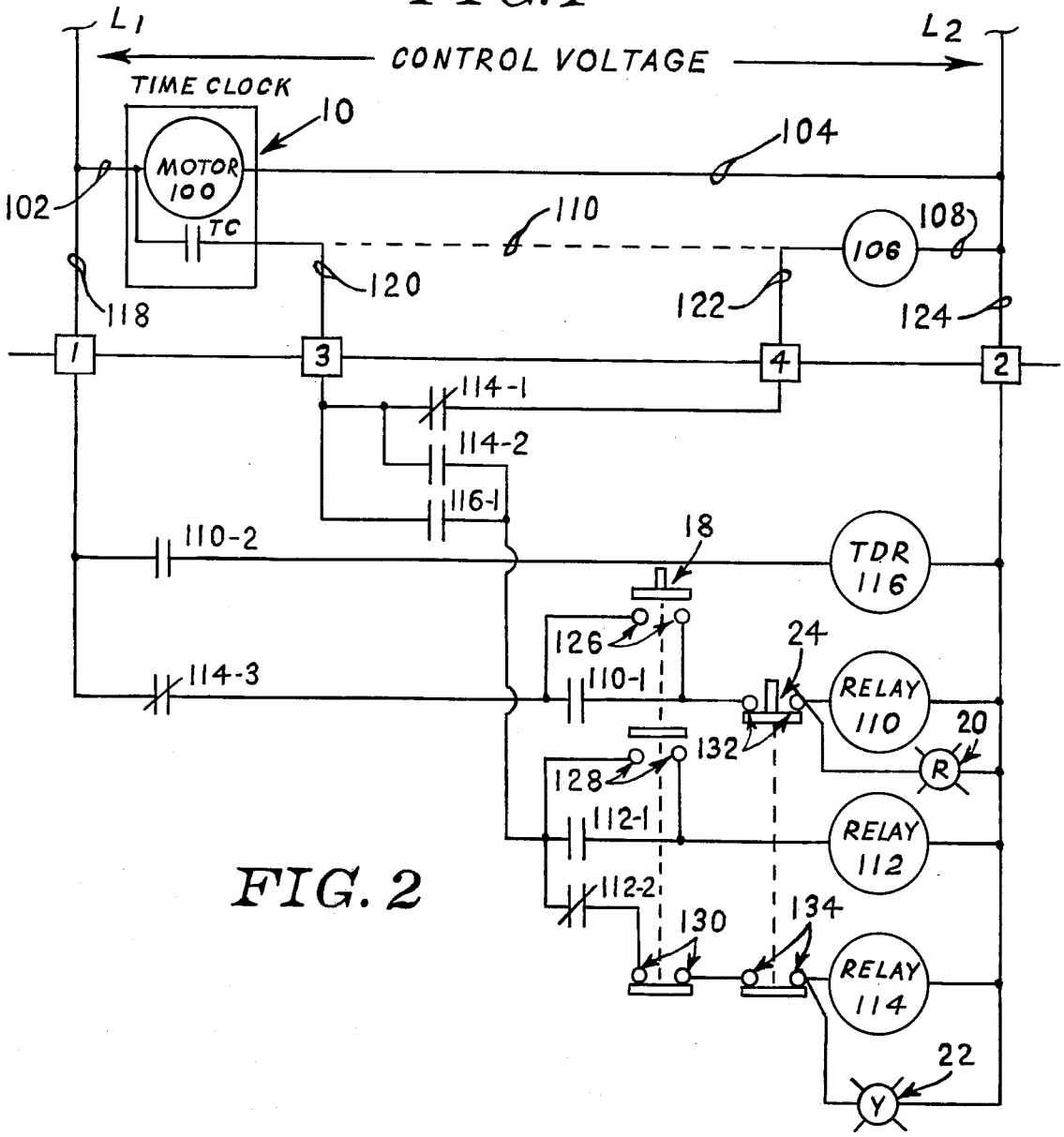
FIG. 2 is a wiring diagram partially in block form and partially in schematic form showing details of the system shown in FIG. 1.

Turning now to FIG. 2, circuit details of a holiday control unit in accordance with the invention are shown. It will be noted that some of the circuit elements shown in FIG. 2 are incorporated in interruption control relay panel 12 of FIG. 1 and others are incorporated in remote control panel 16. For clarity, common reference numbers are used in FIG. 2, where possible, to indicate the partition of the circuit elements between the two blocks 12 and 16. Shown at the top of FIG. 2 is a portion of the time clock 10, including a motor 100 connected to a control voltage by lines 102 and 104. In such a time clock 10, a parallel circuit path is usually provided including a control relay 106, also connected to the control voltage by means of lines 108 and 110. Line 110 is shown in dotted line form to indicate that it has been removed for installation of the holiday control unit.

The holiday control unit includes a first relay 110 for setting the unit in operation. A second relay 112 is activated if the unit is set into operation when the time clock is on. A third relay 114 is used to bypass the control relay 106. A fourth relay 116 incorporating a delay for turn-off, after a signal to turn it off is given, is included for operation of the unit to prevent failure, as explained below. Some of the relays 110–116 have more than one set of contacts. The sets of contacts from the relays are identified at various points in the circuit; for example, the designation 110-1 refers to the first set of contacts of relay 110. The designation 114-3 refers to the third set of contacts in relay 114. These contacts interconnect the relays 110–116 and connect the holiday control unit to the time clock 10 as shown in the drawing. As indicated, the holiday control unit is connected to the time clock 10 by four separate wires 118, 120, 122 and 124. Start button 18 is arranged to close normally open contacts 126 and 128, and to open normally closed contacts 130. Similarly, reset switch 24 is arranged to open normally closed contacts 132 and 134. Red indicator light 20 is connected parallel to relay 110. Yellow indicator light 22 is connected parallel to relay 114.

In operation, when start button 18 is pushed, contacts 126 and 128 are closed and contacts 130 are opened. Relay 110 is pulled in and held in by its contacts 110-1. The red set light 20 is lit, indicating that the unit is in operation. Relay contact 110-2 is closed, pulling in the time delay relay 116, closing its contacts 116-1. This allows relay 112 to pull in if the time clock 10 has energized control relay 106. In that case, relay 112 is held in by its contacts 112-1. Relay 114 is prevented from pulling in by contacts 130 which are open until relay 112 has pulled in, opening its contacts 112-2 so that relay 114 will not operate. If the time clock 10 is not energizing control relay 106 at the time start button 18 is pushed, neither relay 112 nor relay 114 will operate.

Assuming that the time clock was on when switch 18 was energized, relay 112 will drop out when the time clock 10 turns off, thus opening its contacts 112-1 and closing its contacts 112-2. When the time clock 10 turns back on again for its next normal period of operation, relay 114 will pull in and the yellow holiday light 22 will come on. When this occurs, contacts 114-1 will open to prevent control relay 106 from being energized. Contacts 114-2 also close to bypass time delay relay contacts 116-1, and contact 114-3 will open to drop out relay 110, thus turning out red set light 20. This opens contacts 110-1 and contacts 110-2, thus terminating power to the time delay relay 116. After one second time delay, time delay relay contact 116-1 will open. The unit is now in the holiday position and has reset itself.

When the time clock 10 turns off again, relay 114 will drop, closing contacts 114-1 and 114-3 and opening contacts 114-2. This turns off the yellow holiday light 22. The next time that the time clock 10 turns on the control relay 106 will pull in and the system will go back into normal operation. Reset button 24 can be pushed at any time during the sequence of operation to drop relay 110 or relay 114 and return the system to normal operation.

The holiday control unit as shown is capable of interrupting normal operation of a time clock controlled circuit for one daily cycle of operation. If it is desired to interrupt normal operation for a second day, another interruption control unit can be connected serially to the first unit. In such a case, the first unit would control the first day's interruption, and the second unit would control the second day's interruption.

In summary, any time the start button 18 is pushed, the holiday control unit is put into operation. If the button is pushed when control relay 106 is energized by time clock 10, the operation is not interrupted. If button 18 is pushed when the system is off, the system is not started. If start button 18 is pushed accidentally, it can be cleared by pushing reset button 24. When the unit is set in operation a red indicator light 20 comes on, showing that the unit is set to operate.

After the unit is set to operate, the next time that the time clock turns on, the system will not operate, the red set light 20 will go out and the yellow holiday light 22 will come on, indicating interrupted operation. The next time that time clock 10 turns off, the yellow holiday light 22 will go off. The next time time clock 10 turns on, it will energize relay 106 in the normal fashion. The holiday light 22 and interruption operation can be cleared by pushing the reset button 24. It should be noted that the system cannot be turned on or off from the control panel 16. It can only be set to miss its next period of operation.

It should now be apparent to those skilled in the art that a holiday control unit capable of achieving the stated objects of the invention has been provided. The unit can be installed with existing time clock systems, without substantial modification of them. The holiday control unit is easily operated by personnel not familiar with time clock system operation, and without access to the time clock itself.

It should further be apparent to the art skilled that various changes in the form and detail may be made in the holiday control unit as described. It is intended that such changes be included within the spirit and scope of the claims appended hereto.

What is claimed is:

1. A unit for interrupting normal operation of an electrical circuit for one cycle energized during such a cycle by a time clock, which comprises:

(a) A first relay connected to said time clock to set said unit in operation, (b) a start switch connected to close a first set of contacts in said first relay, (c) a second relay which has a turn-off time delay serially connected to a second set of contacts in said first relay, said second relay having a set of contacts serially connected to said time clock, (d) a third relay having a first set of contacts serially connected to said set of contacts of said second relay, and (e) a fourth relay having a first set of contacts connected to be opened when said start switch closes said first set of contacts of said fourth relay, said first set of contacts of said fourth relay being serially connected to a second set of contacts in said third relay, connected to close when said start switch closes said first set of contacts in said first relay.

2. A unit for interrupting normal operation of an electrical circuit for one cycle, usually energized during such a cycle by a time clock, which comprises:

(a) a first means actuable by means of a switch for bypassing said control circuit at any time when it is desired to interrupt normal operation of said circuit during the next cycle, (b) second means for allowing said control circuit to continue its function if said circuit is in operation when the switch is closed, and (c) third means for bypassing said control circuit after actuation of said second means, said second bypassing means turning off when said time clock turns off after actuation of said second means, said third bypassing means turning on when said time clock turns on again, and said third bypassing means returning said circuit to normal operation when said time clock turns off once again.

3. The unit of claim 2 additionally comprising means for resetting said unit to return the circuit to normal operation independently of the state of the circuit or the unit at the time resetting is desired.

4. A unit for interrupting normal operation of an electrical circuit, which comprises a unit as in claim 3, and an additional such unit serially connected to said first unit.

5. In combination, a time clock, a control circuit connected to and operable by said time clock, and the unit of claim 2.

* * * * *